US006636708B2

(12) United States Patent
Takahashi

(10) Patent No.: US 6,636,708 B2
(45) Date of Patent: Oct. 21, 2003

(54) IMAGE FORMING APPARATUS AND SYSTEM WITH A TRANSFER DEVICE HAVING AN ADJUSTABLE TRANSFER BIAS

(75) Inventor: Masashi Takahashi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/932,961

(22) Filed: Aug. 21, 2001

(65) Prior Publication Data

US 2003/0039479 A1 Feb. 27, 2003

(51) Int. Cl.[7] ..... G03G 15/16
(52) U.S. Cl. ..... 399/66
(58) Field of Search ..... 399/11, 8, 66, 399/138, 299, 306, 303, 312, 314, 45, 47

(56) References Cited

U.S. PATENT DOCUMENTS 5,140,349 A * 8/1992 Abe et al. ..... 347/129
5,848,321 A * 12/1998 Roh et al. ..... 399/389
6,021,286 A * 2/2000 Kawai et al. ..... 399/299
6,029,022 A * 2/2000 Takase ..... 399/299
6,104,893 A * 8/2000 Byeon et al. ..... 399/66

FOREIGN PATENT DOCUMENTS

JP 5-165288 7/1993
JP 06308844 A * 11/1994 ..... G03G/15/16
JP 09160314 A * 6/1997 ..... G03G/15/00
JP 11-84769 3/1999
JP 11-99728 4/1999
JP 11125978 A * 5/1999 ..... G03G/15/16

* cited by examiner

*Primary Examiner*—Robert Beatty
(74) *Attorney, Agent, or Firm*—Foley & Lardner

(57) ABSTRACT

An LCD section of a control panel displays an AUTO key and a manual key for adjusting the density of an image, and an AUTO key and a manual key (TRANSFER INTENSITY) for directly varying transfer biases. When the AUTO of the TRANSFER INTENSITY has been depressed, a printer CPU causes a transfer bias control section to perform a control to set the transfer biases from DC power supplies associated with respective colors at normal conditions in accordance with a print ratio or average reflectance of an original. When the manual key of the TRANSFER INTENSITY is set to the right side, the printer CPU increases stepwise the transfer biases in accordance with the setting. When the manual key is set to the left side, the printer CPU decreases stepwise the transfer biases in accordance with the setting.

10 Claims, 9 Drawing Sheets

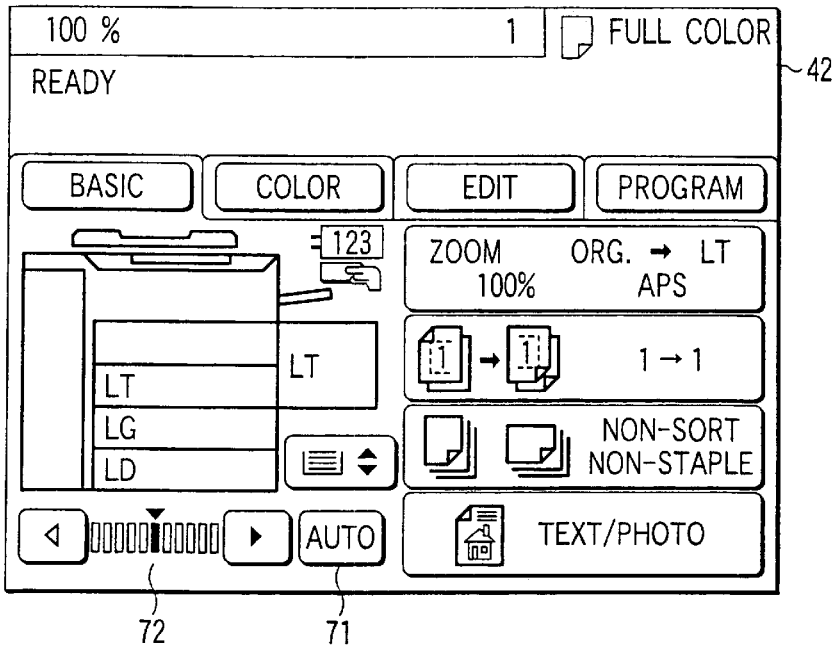
FIG. 5 (PRIOR ART)
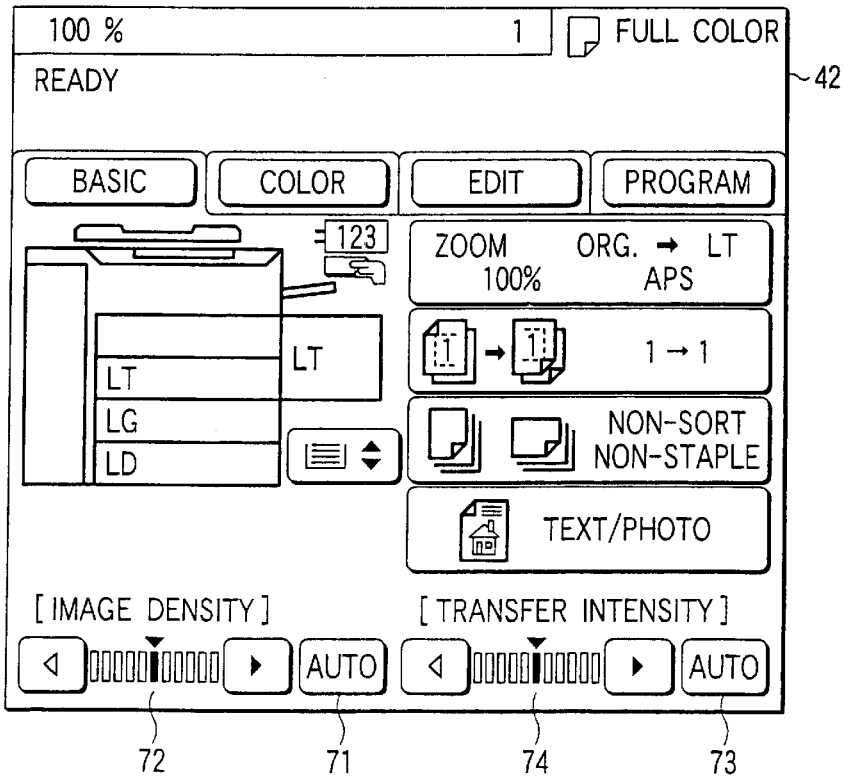
FIG. 6

| | | Color Y ; M ; C ; K | Monochromatic |
|---|---|---|---|
| Ordinary paper | Default condition (V) | 1300 ; 1300 ; 1400 ; 1300 | 1100 |
| | P-50S | 1400 ; 1600 ; 1600 ; 1400 | 1300 |
| | Premium Copy Paper | 1300 ; 1300 ; 1400 ; 1300 | 1300 |
| | Premium Copy Paper Recycled | 1400 ; 1400 ; 1400 ; 1400 ~ 1400 ; 1600 ; 1600 ; 1400 | 1300 |
| | Tidl DP | 1300 ; 1400 ; 1500 ; 1400 ~ 1400 ; 1600 ; 1600 ; 1400 | 1300 |
| | Natura 95 | 1400 ; 1600 ; 1600 ; 1400 | 1300 |
| | Coupons RC | 1400 ; 1400 ; 1400 ; 1400 | 1300 |
| | Steinbeis Copy Paper | 1300 ; 1300 ; 1400 ; 1300 | 1100 |
| | CL-500 | 1300 ; 1500 ; 1600 ; 1400 | 1300 |
| | Multi-system | 1300 ; 1300 ; 1400 ; 1300 | 1300 |
| Thick paper 1 | Color Copy Paper | 1400 ; 1400 ; 1400 ; 1400 | 1300 |
| Thick paper 3 | Default condition (V) | 1400 ; 1400 ; 1400 ; 1400 | 1400 |
| | Spectratech Index | 1400 ; 1400 ; 1400 ; 1400 | 1300 |

FIG. 9

IMAGE FORMING APPARATUS AND SYSTEM WITH A TRANSFER DEVICE HAVING AN ADJUSTABLE TRANSFER BIAS

BACKGROUND OF THE INVENTION

The present invention relates to a belt transfer type image forming apparatus for use in an electro-photographic copying machine, printer, etc., and more particularly to a belt transfer type image forming apparatus for use in a four-drum tandem type color copying machine and color printer.

A most known technique relating to a transfer section of a prior-art electrophotographic image forming apparatus is a transfer technique using a corona charger disposed to face a photosensitive drum.

However, harmful ozone is generated in this method.

As an ozone-free transfer technique, a contact-type transfer technique is known. Jpn. Pat. Appln. KOKAI Publication No. 6-110343 discloses a technique for performing transfer using a semiconducting transfer belt and a transfer roller disposed on the back side of the transfer belt. In this technique, transfer is effected by applying a transfer bias to the transfer roller.

Color image forming apparatuses for forming color images of plural toners of color components Y (yellow), M (magenta), C (cyan) and K (black) adopt the following known methods:

(1) A method in which four color toners are overlapped on a single photosensitive drum to form an image, and the image is transferred at a time, (2) A transfer drum method in which a transfer medium is held on a transfer drum, and a four-color image is formed by four rotations of the transfer drum, (3) An intermediate transfer body method in which a four-color image is formed on an intermediate transfer body, and the image is transferred on a transfer medium at a time, and (4) A four-drum method in which four photosensitive bodies are disposed in parallel, and a four-color image is formed while a transfer medium is made to pass by the four photosensitive bodies ("single pass").

In the four-drum type color image forming apparatus, color images formed on four parallel-arranged image carrying bodies are multiply transferred on a transfer medium by a single pass of the transfer medium. This apparatus is advantageous in that a color image can be formed in a quarter of the time needed in the other methods in four-color image forming processes. Therefore, high-speed operations can be performed by this apparatus.

A conventional color copying machine is equipped with a control panel having a density adjustment key for adjusting the density of an output image. Alternatively, the control panel has a key for selecting the kind of originals such as a character image, a character/photograph combination image and a photographic image. Alternatively, the control panel has a key for selecting the kind of sheets such as an ordinary sheet, a thick sheet, an OHP sheet and a postcard.

The density adjustment key functions to alter a development contrast potential or a tone curve correction coefficient. In accordance with the selection of the kind of the original, the image processing condition such as a screen structure is altered. In accordance with the selection of the kind of the sheet, the condition for transfer bias is altered. However, if there is a choice that does not belong to the specified classifications, the transfer bias condition cannot be altered.

In some apparatuses, the transfer bias condition is controlled according to the environment in which the apparatus is situated. Specifically, an environmental sensor provided in the apparatus senses the environment such as temperature and humidity, and the transfer bias condition is controlled in the sensed environment.

However, the change of the transfer bias condition is automatically controlled and cannot manually be adjusted by the user.

In the conventional color image formation apparatus, the control panel or display screen is equipped with a density adjustment key, a sheet kind selection key, an original kind selection key, a color balance adjustment key, etc. These keys provide user-controllable functions for obtaining better copy images (print images). Since so many parameters are associated with the color image formation process, these parameters can be made controllable.

In the conventional apparatus, a process condition for transferring a toner image on a transfer medium (more specifically a condition for a transfer bias applied to a transfer medium), which is one of color image formation processes, cannot manually be altered by the user's (operator's) operation of a switch key. Thus, a transfer process is performed under the same transfer bias condition for an original with high density and an original with low density.

Besides, when a sheet does not belong to specified classifications such as ordinary sheets or thick sheets, the transfer bias condition cannot be altered. Even if sheets to be used by the user belong to the classification of ordinary sheets, if the sheets are not the maker's recommendable ones, optimal transfer bias conditions for the sheets cannot be selected.

Furthermore, if the actual environment of an apparatus differs from an environment sensed by an environment sensor of the apparatus, the transfer bias setting condition may differ from an optimal transfer bias condition. In such a case, an optimal transfer bias condition cannot be selected, and a better image quality cannot be obtained, In the industrial fields of printing and graphic designs, there is a demand for improved image quality adjustment in color image forming apparatuses.

BRIEF SUMMARY OF THE INVENTION

The object of the present invention is to provide an image forming apparatus and an image forming system capable of adjusting a transfer bias condition and performing transfer under an optimal transfer bias condition, thus enhancing an image quality.

In order to achieve the object, this invention provides an image forming apparatus comprising: developing means for forming toner images on a plurality of image carrying bodies; a transfer belt for conveying a sheet, the transfer belt being disposed in contact with the image carrying bodies on which the toner images are formed by the developing means; a plurality of transfer means, provided at positions where the transfer belt is put in contact with the image carrying bodies, for transferring the toner images formed on the respective image carrying bodies onto the sheet conveyed by the transfer belt; setting means for setting transfer bias conditions of the plural transfer means; and control means for controlling bias voltages applied to the respective transfer means in accordance with the transfer bias conditions set by the setting means.

The invention provides an image forming apparatus comprising: read means for reading an image on an original; developing means for forming toner images on a plurality of image carrying bodies on the basis of the original image read by the read means; a transfer belt for conveying a sheet, the transfer belt being disposed in contact with the image carrying bodies on which the toner images are formed by the developing means; a plurality of transfer means, provided at positions where the transfer belt is put in contact with the image carrying bodies, for transferring the toner images formed on the respective image carrying bodies onto the sheet conveyed by the transfer belt; adjustment means for adjusting an image formation density of the original when the image on the original is read by the read means; first control means for controlling, when the image formation density of the original has been adjusted to a high density side by the adjustment means, the transfer bias conditions of the plural transfer means to confirm to high density transfer bias conditions; and second control means for controlling, when the image formation density of the original has been adjusted to a low density side by the adjustment means, the transfer bias conditions of the plural transfer means to confirm to low density transfer bias conditions.

The invention provides an image forming apparatus comprising: read means for reading an image on an original; developing means for forming toner images on a plurality of image carrying bodies on the basis of the original image read by the read means; a transfer belt for conveying a sheet, the transfer belt being disposed in contact with the image carrying bodies on which the toner images are formed by the developing means; a plurality of transfer means, provided at positions where the transfer belt is put in contact with the image carrying bodies, for transferring the toner images formed on the respective image carrying bodies onto the sheet conveyed by the transfer belt; switching means for switching a normal mode to a high print ratio image transfer mode in a case where, when the image on the original is read by the read means, the original is a high density image original or a high print ratio image original; and control means for controlling, when the normal mode has been switched to the high print ratio image transfer mode by the switching means, the transfer bias conditions of the plural transfer means to confirm to transfer bias conditions for the high print ratio image transfer mode.

The invention provides an image forming apparatus comprising: read means for reading an image on an original; developing means for forming toner images on a plurality of image carrying bodies on the basis of the original image read by the read means; a transfer belt for conveying a sheet, the transfer belt being disposed in contact with the image carrying bodies on which the toner images are formed by the developing means; a plurality of transfer means, provided at positions where the transfer belt is put in contact with the image carrying bodies, for transferring the toner images formed on the respective image carrying bodies onto the sheet conveyed by the transfer belt; select means for selecting one of a normal mode, a high print ratio image transfer mode and a highlight image transfer mode in accordance with the original when the image on the original is read by the read means; and control means for controlling the transfer bias conditions of the plural transfer means in accordance with the mode selected by the select means.

The invention provides an image forming apparatus comprising: read means for reading an image on an original; developing means for forming toner images on a plurality of image carrying bodies on the basis of the original image read by the read means; a transfer belt for conveying a sheet, the transfer belt being disposed in contact with the image carrying bodies on which the toner images are formed by the developing means; a plurality of transfer means, provided at positions where the transfer belt is put in contact with the image carrying bodies, for transferring the toner images formed on the respective image carrying bodies onto the sheet conveyed by the transfer belt; adjustment means for adjusting in multiple steps an image formation density of the original when the image on the original is read by the read means; and control means for controlling, when the image formation density of the original has been adjusted to a high density side or a low density side by the adjustment means, the transfer bias conditions of the plural transfer means in accordance with the adjustment step on the high density side or the adjustment step on the low density side.

The invention provides an image forming apparatus comprising: read means for reading an image by scanning an original; developing means for forming toner images on a plurality of image carrying bodies on the basis of the original image read by the read means; a transfer belt for conveying a sheet, the transfer belt being disposed in contact with the image carrying bodies on which the toner images are formed by the developing means; a plurality of transfer means, provided at positions where the transfer belt is put in contact with the image carrying bodies, for transferring the toner images formed on the respective image carrying bodies onto the sheet conveyed by the transfer belt; calculation means for calculating an average reflectance of the whole image of the original when the original is pre-scanned by the read means; and control means for performing a control to switch, when the average reflectance calculated by the calculation means is a predetermined first set value or less, transfer bias conditions of the plural transfer images to transfer bias conditions for a high density image, and to switch, when the average reflectance calculated by the calculation means is a second set value or more, which is different from the predetermined first set value, the transfer bias conditions of the plural transfer images to transfer bias conditions for a low density image.

The invention provides an image forming apparatus comprising: read means for reading an image by scanning an original; developing means for forming toner images on a plurality of image carrying bodies on the basis of the original image read by the read means; a transfer belt for conveying a sheet, the transfer belt being disposed in contact with the image carrying bodies on which the toner images are formed by the developing means; a plurality of transfer means, provided at positions where the transfer belt is put in contact with the image carrying bodies, for transferring the toner images formed on the respective image carrying bodies onto the sheet conveyed by the transfer belt; calculation means for calculating an average reflectance of the whole image of the original with respect to each of color components of yellow, magenta, cyan and black, when the original is pre-scanned by the read means; and control means for performing a control to switch, when the average reflectance calculated by the calculation means with respect to each of the color components of yellow, magenta, cyan and black is a predetermined first set value or less, transfer bias conditions of the plural transfer images to transfer bias conditions for a high density image, and to switch, when the average reflectance calculated by the calculation means with respect to each of the color components of yellow, magenta, cyan and black is a second set value or more, which is different from the predetermined first set value, the transfer bias conditions of the plural transfer images to transfer bias conditions for a low density image.

The invention provides an image forming system wherein a personal computer is connected to an image forming apparatus via a communication line to form an image, the personal computer comprising: display means for displaying a screen for controlling the image forming apparatus; and setting means for selecting and setting one of a high density image transfer mode and a low density image transfer mode associated with transfer bias conditions in the image forming apparatus, by means of the screen displayed on the display means for controlling the image forming apparatus, the image forming apparatus comprising: developing means for forming toner images on a plurality of image carrying bodies; a transfer belt for conveying a sheet, the transfer belt being disposed in contact with the image carrying bodies on which the toner images are formed by the developing means; a plurality of transfer means, provided at positions where the transfer belt is put in contact with the image carrying bodies, for transferring the toner images formed on the respective image carrying bodies onto the sheet conveyed by the transfer belt; and control means for controlling bias voltages applied to the transfer means on the basis of the transfer bias conditions associated with the high density image transfer mode or low density image transfer mode set by the setting means.

The invention provides an image forming apparatus comprising: read means for reading an image on an original; developing means for forming toner images on a plurality of image carrying bodies on the basis of the original image read by the read means; a transfer belt for conveying a sheet, the transfer belt being disposed in contact with the image carrying bodies on which the toner images are formed by the developing means; a plurality of transfer means, provided at positions where the transfer belt is put in contact with the image carrying bodies, for transferring the toner images formed on the respective image carrying bodies onto the sheet conveyed by the transfer belt; and control means for performing a control to switch, when a print ratio of the original read by the read means is a predetermined first print ratio or more, transfer bias conditions of the plural transfer images to transfer bias conditions for a high density image, and to switch, when the print ratio of the original read by the read means is a second print ratio or less, which is different from the predetermined first print ratio, the transfer bias conditions of the plural transfer images to transfer bias conditions for a low density image.

The invention provides an image forming apparatus, maintenance of which is controlled via a pre-connected communication line, the apparatus comprising: developing means for forming toner images on a plurality of image carrying bodies; a transfer belt for conveying a sheet, the transfer belt being disposed in contact with the image carrying bodies on which the toner images are formed by the developing means; a plurality of transfer means, provided at positions where the transfer belt is put in contact with the image carrying bodies, for transferring the toner images formed on the respective image carrying bodies onto the sheet conveyed by the transfer belt; and control means for controlling bias voltages applied to the respective transfer means in accordance with transfer bias conditions set by the control of the maintenance.

BRIEF DESCRIPTION OF THE SEVERAL VIEWS OF THE DRAWING

FIG. 5 shows an example of prior-art display on an LCD section of a control panel;

FIG. 6 shows an example of display according to a first embodiment on the LCD section of the control panel;

FIG. 9 shows optimal transfer bias conditions associated with the kinds of paper;

DETAILED DESCRIPTION OF THE INVENTION

Embodiments of the present invention will now be described with reference to the accompanying drawings.

Figure 1:
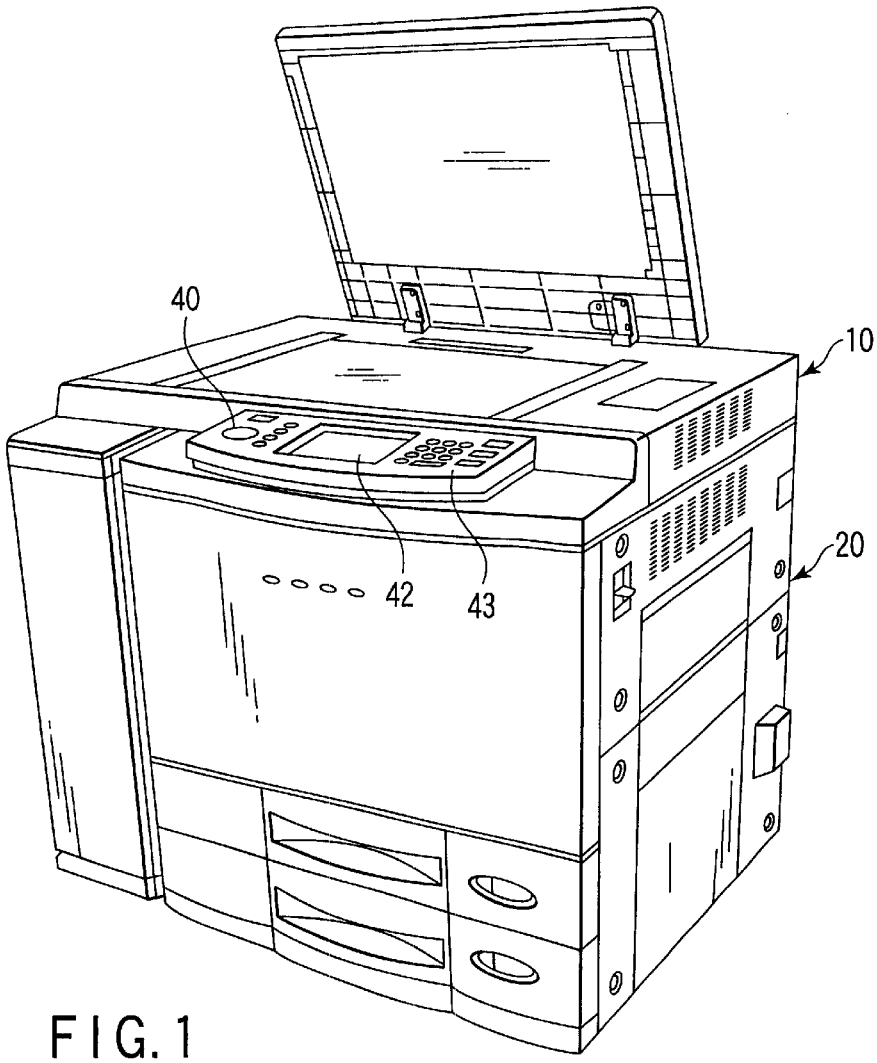
FIG. 1 shows an external structure of a color copying machine according to an image forming apparatus of the present invention.

FIG. 1 shows an external structure of a color copying machine according to an image forming apparatus of the present invention. The color copying machine comprises a scanner section 10, a printer section 20, and a control panel 40 provided at an upper front portion of the machine. The control panel 40 has an LCD section 42 and various operation keys 43. The LCD section 42 is an LCD having a touch panel. Portions on the touch panel, which correspond to the various operation keys displayed on the LCD, are depressed, and input operations are effected.

Figure 2:
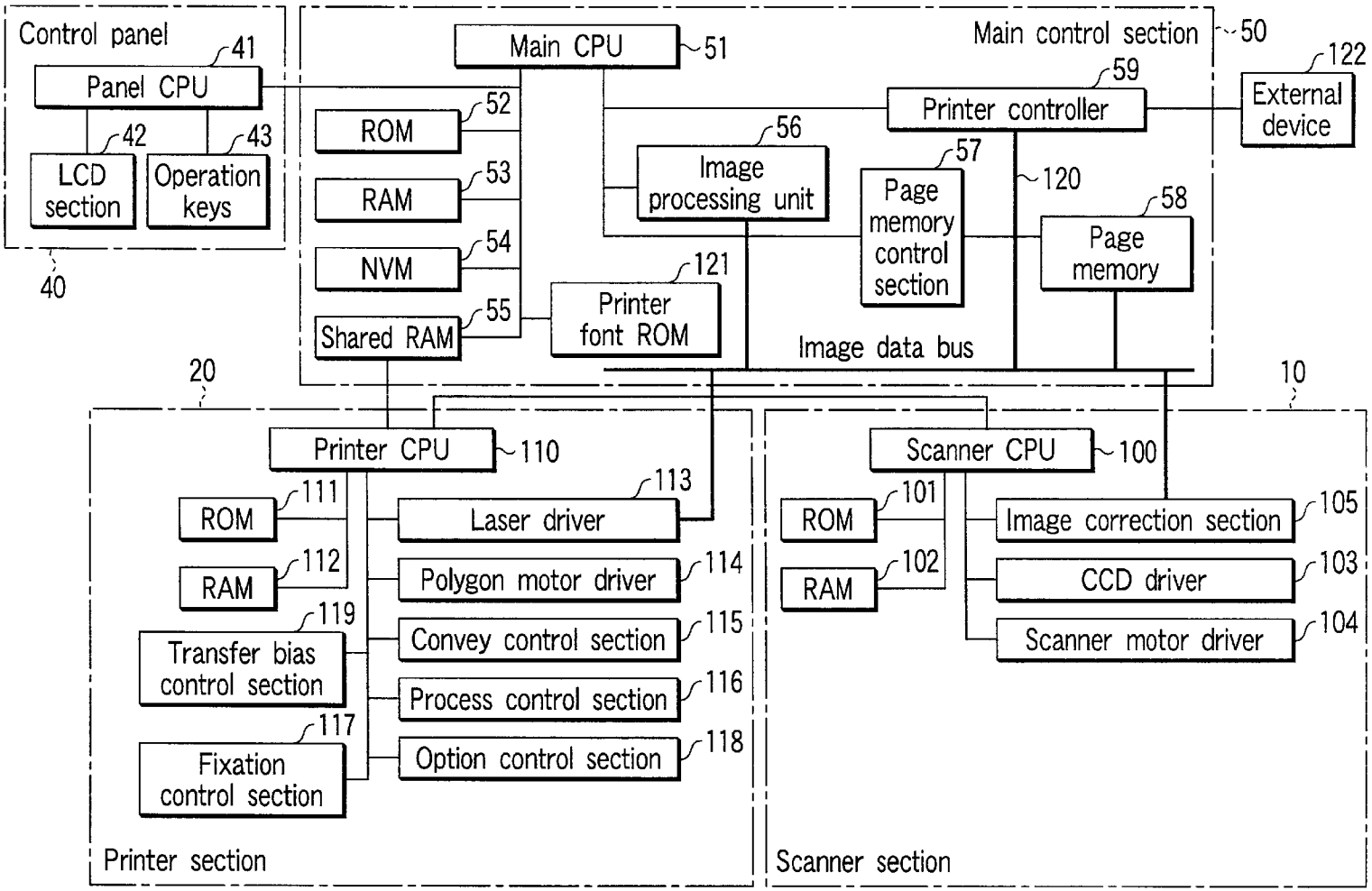
FIG. 2 is a block diagram schematically illustrating electrical connection in the color copying machine shown in FIG. 1, and a flow of signals for control.

FIG. 2 is a block diagram schematically showing electrical connection of the color copying machine shown in FIG. 1 and flow of signals for control. In FIG. 2, a control system comprises three CPUs (Central Processing Units): a main CPU 51 provided in a main control section 50; a scanner CPU 100 in the scanner section 10; and a printer CPU 110 in the printer section 20.

The main CPU 51 performs bi-directional communication with the printer CPU 110 via a shared RAM (Random Access Memory) 55. The main CPU 51 issues an operational instruction, and the printer CPU 110 returns status data. Serial communication is performed between the printer CPU 110 and scanner CPU 100. The printer CPU 110 issues an operational instruction, and the scanner CPU 100 returns status data.

The control panel 40 comprises the LCD section 42, various operation keys 43 and a panel CPU 41 to which these are connected. The control panel 40 is connected to the main CPU 51.

The main control section 50 comprises the main CPU 51, a ROM (Read-Only Memory) 52, a RAM 53, an NVM 54, shared RAM 55, an image processing unit 56, a page memory control unit 57, a page memory 58, a printer controller 59, and a printer font ROM 121.

The main CPU 51 performs an entire control. The ROM 52 stores control programs, etc. The RAM 53 temporarily stores data.

The NVM (Non-Volatile RAM) 54 is a non-volatile memory backed up by a battery (not shown), and even when power is not supplied, stored data is maintained.

The shared RAM 55 is used to perform bi-directional communication between the main CPU 51 and printer CPU 110.

The page memory control unit 57 stores and read out image information in and from the page memory 58. The page memory 58 has areas capable of storing image information of a plurality of pages. The page memory 58 can store compressed data in units of a page, which is obtained by compressing image information from the color scanner section 10.

The printer font ROM 121 stores font data corresponding to print data. The printer controller 59 develops print data, which is sent from an external device 122 such as a personal computer, into image data using the font data stored in the printer font ROM 121 with a resolution corresponding to resolution data added to the print data.

The scanner section 10 comprises the scanner CPU 100 for controlling the entirety of the color scanner section 10; a ROM 101 storing control programs, etc.; a data storage RAM 102; a CCD driver 103 for driving a color image sensor; a scan motor driver 104 for controlling the rotation of a scan motor for moving a first carriage, etc.; and an image correction section 105.

The image correction section 105 comprises an A/D converter for converting R-, G- and B-analog signals output from the color image sensor to digital signals; a shading correction circuit for correcting a variance in the color image sensor or a variation in threshold level due to ambient temperature variation relative to the output signal from the color image sensor; and a line memory for temporarily storing shading-corrected digital signals from the shading correction circuit.

The printer section 20 comprises the printer CPU 110 for controlling the entirety of the printer section 20; a ROM 111 storing control programs, etc.; a data storage RAM 112; a laser driver 113 for driving a semiconductor laser; a polygon motor driver 114 for driving a polygon motor of an exposure device; a convey control section 115 for controlling conveyance of a sheet P by a convey mechanism; a process control section 116 for controlling charging, developing and transferring processes using chargers, electrifying devices, developing devices and transfer devices associated with four colors, Y, M, C and K, as will be described later in detail; a fixation control section 117 for controlling a fixing device; an option control section 118 for controlling options; and a transfer bias control section 119 for controlling a transfer bias of each transfer device, as will be described later in detail.

The image processing unit 56, page memory 58, printer controller 59, image correction section 105 and laser driver 113 are connected over an image data bus 120.

Figure 3:
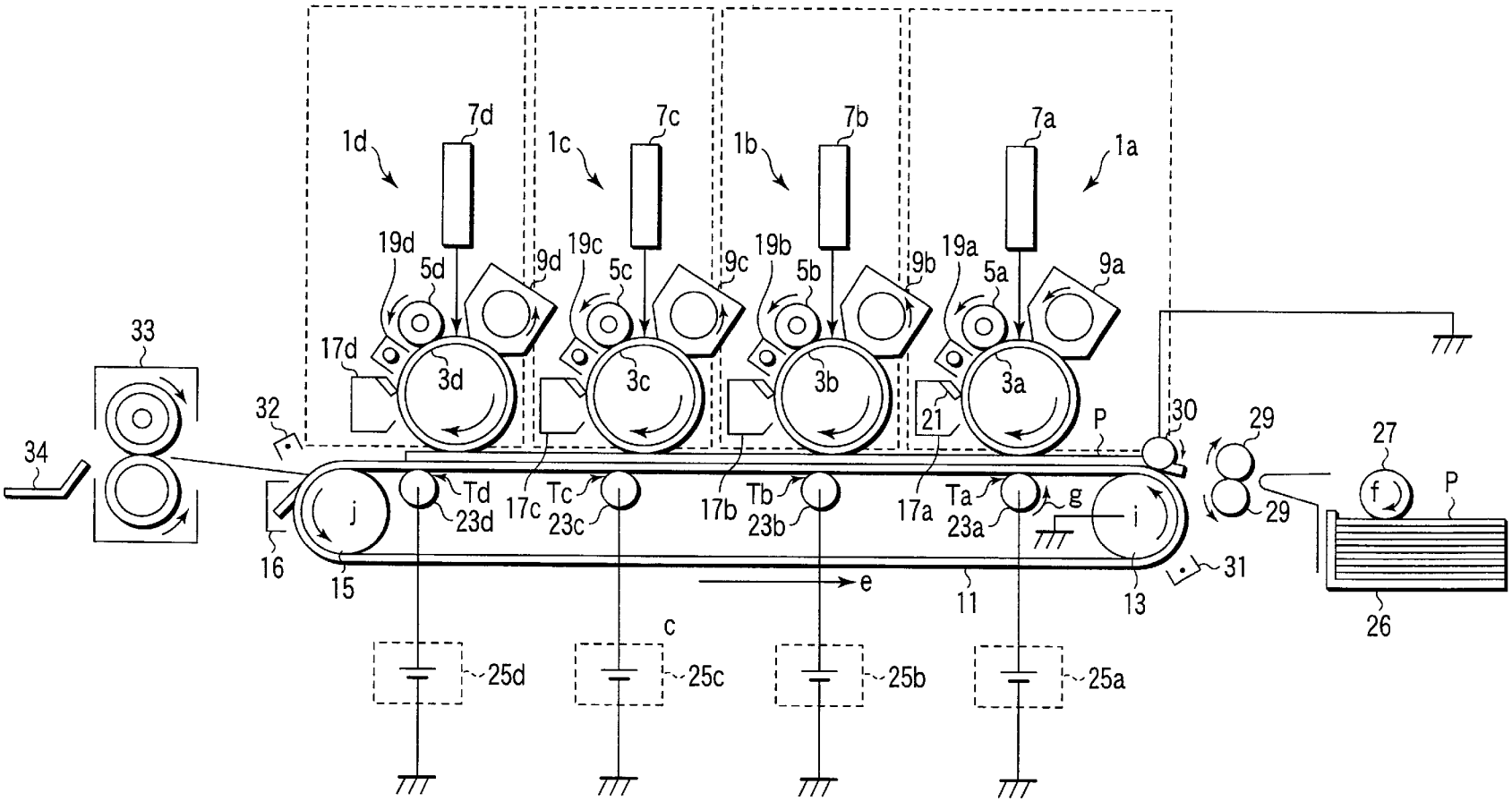
FIG. 3 schematically shows the structure of a belt-transfer type image forming section in a four-drum tandem system associated with four developers used in the color copying machine.

FIG. 3 schematically shows the structure of a belt-transfer type image forming section in a four-drum tandem system associated with four color developers used in the color copying machine, i.e. yellow (Y), magenta (M), cyan (C) and black (K).

In FIG. 3, the image forming section comprises process units 1*a*, 1*b*, 1*c* and 1*d*.

The process units 1*a*, 1*b*, 1*c* and 1*d* have photosensitive drums 3*a*, 3*b*, 3*c* and 3*d* functioning as image carrying bodies. Developer images are formed on the photosensitive drums 3*a*, 3*b*, 3*c* and 3*d*.

The process unit 1*a* will now be described.

In FIG. 3, the photosensitive drum 3*a* has a cylindrical shape with a diameter of 30 mm and is rotatable in the direction of an arrow. The following elements are disposed around the photosensitive drum 3*a* in the direction of rotation. A charger 5*a* is disposed to face the surface of the photosensitive drum 1*a*. The charger 5*a* negatively charges the photosensitive drum 3*a* uniformly. On the downstream side of the charger 5*a* (on the right side in FIG. 3), an exposure device 7*a* is disposed for exposing the charged photosensitive drum 3*a*, thereby forming an electrostatic latent image.

On the downstream side of the charger 7*a*, a developing device 9*a* is disposed, which contains a yellow developer and inversely develops the electrostatic latent image formed by the exposure device 7*a* by using the developer. A convey belt 11 is disposed on the downstream side of the developing device 9*a*. The convey belt 11 functions as convey means for conveying a sheet P, or an image forming medium, to the photosensitive drum 3*a*. The convey belt 11 conveys the sheet P to the photosensitive drum 3*a* so that the yellow developer image formed on the photosensitive drum 3*a* may come in contact with the sheet P.

A cleaning device 17*a* and a charge erase lamp 19*a* are disposed on the downstream side of the contact point between the photosensitive drum 3*a* and sheet P. The cleaning device 17*a* has a blade 21. The blade 21 removes the developer remaining on the photosensitive drum 3*a* after transfer. The charge erase lamp 19*a* erases the surface charge on the photosensitive drum 3*a* after transfer by uniform light illumination. One cycle of image formation is completed by the erasure of charge by the charge erase lamp 19*a*. In the next image forming process, the charger 5*a* uniformly charges the photosensitive drum 3*a* that is not charged.

The process unit 1*a* is composed of the above-described photosensitive drum 3*a*, charger 5*a*, exposure device 7*a*, developing device 9*a*, cleaning device 17*a* and charge erase lamp 19*a*.

The convey belt 11 has a length (width) substantially equal to the length of the photosensitive drum 1*a* in a direction (the depth direction in the Figure) perpendicular to the direction of conveyance of sheet P (the direction of arrow e). The convey belt 11 is a seamless belt and is supported on a driving roller 15 and a driven roller 13 which rotate the convey belt 11 at a predetermined speed.

The distance between the driving roller 15 and driven roller 13 is about 300 mm. The driving roller 15 and driven roller 13 are rotatable in the directions of arrows j and i, respectively. In accordance with the rotation of the driving roller 15, the convey belt 11 rotates and the driven roller 13 is driven. The convey belt 11 is provided with enough tension to prevent slip due to a load in the outside direction of the driven roller 13. The convey belt 11 is formed of polyimide with a thickness of 100 $\mu$m, in which carbon is uniformly dispersed. The convey belt has an electric resistance of $10^{10}$ Ωcm and has semiconducting properties.

The convey belt 11 may be formed of any material having a volume resistance of $10^{8}$ to $10^{13}$ Ωcm. In addition to the carbon-dispersed polyimide, examples of such material include polyethylene terephthalate, polycarbonate, polytetrafluoroethylene, or polyvinylidene fluoride, in which conductor particles such as carbon particles are dispersed.

Alternatively, the conductor particles may not be used, and a high polymer film having an electric resistance adjusted by composition may be used. Furthermore, a high polymer film mixed with an ion conductive substance or a rubber material with relatively low electric resistance, such as silicone rubber or urethane rubber, may be used.

The process units 1*b*, 1*c* and 1*d*, as well as the process unit 1*a*, are disposed over the convey belt 11 in the direction of conveyance of the sheet P between the driving roller 15 and driven roller 13. The process units 1*b*, 1*c* and 1*d* have substantially the same structure as the process unit 1*a*. Specifically, the photosensitive drums 3*b*, 3*c* and 3*d* are provided at substantially central portions of these process units.

Chargers 5*b*, 5*c* and 5*d* are provided around the photosensitive drums 3*b*, 3*c* and 3*d*. Exposure devices 7*b*, 7*c* and 7*d* are disposed on the downstream side of the chargers. Like the process unit 1*a*, developing devices 9*b*, 9*c* and 9*d*, cleaning devices 17*b*, 17*c* and 17*d*, and charge erase lamps 19*b*, 19*c* and 19*d* are provided on the downstream side of the exposure devices. A different point is the developers contained in the developing devices. The developing device 19*b* contains a magenta developer, the developing device 19*c* contains a cyan developer, and the developing device 19*d* contains a black developer. The sheet P conveyed by the convey belt 11 is successively brought into contact with the photosensitive drums 3*b*, 3*c* and 3*d*.

Transfer devices 23*a*, 23*b*, 23*c* and 23*d* functioning as transfer means are disposed in association with the photosensitive drums 3*a*, 3*b*, 3*c* and 3*d* in the vicinity of contact points between the sheet P conveyed on the convey belt 11 and the photosensitive drums 3*a*, 3*b*, 3*c* and 3*d*. Specifically, the transfer devices 23*a*, 23*b*, 23*c* and 23*d* are disposed in contact with the back surface of the convey belt 11 below the photosensitive drums 3*a*, 3*b*, 3*c* and 3*d*. The transfer devices 23*a*, 23*b*, 23*c* and 23*d* are opposed to the process units 1*a*, 1*b*, 1*c* and 1*d* with the convey belt 11 interposed.

The transfer member 23*a* is connected to a positive (+) DC power supply 25*a* that is a voltage applying means. Similarly, the transfer members 23*b*, 23*c* and 23*d* are connected to DC power supplies 25*b*, 25*c* and 25*d*.

As will be described later in detail, a setting instruction of a transfer bias, which is input from the LCD section 42, is sent to the printer CPU 110 via the panel CPU 41 and main CPU 51. Based on the set transfer bias, the printer CPU 110 causes the transfer bias control section 119 to control the DC power supplies 25*a*, 25*b*, 25*c* and 25*d*, thereby applying bias voltages to the transfer members 23*a*, 23*b*, 23*c* and 23*d*.

On the other hand, in FIG. 3, a sheet feed cassette 26 for storing sheets P is disposed on the front right side of the convey belt 11. The color copying machine body has a pickup roller 27 that is rotatable in the direction of arrow f and picks up sheets P one by one from the sheet feed cassette 26.

A pair of register rollers 29 are rotatably provided between the pickup roller 27 and the convey belt 11. The register rollers 29 feed a sheet P onto the convey belt 11 at a predetermined timing. A metallic roller 30 for causing the sheet P to be electrostatically attracted on the surface of the convey belt 11 is disposed over the convey belt 11. The metallic roller 30 is grounded. In order to charge the belt for attracting the sheet, the driven roller 13 of the convey belt 11 is used as a counter-electrode, and a corona charger 31 is disposed below the driven roller 13 via the convey belt 11.

In FIG. 3, a fixing device 33 and an output tray 34 are disposed on the front left side of the convey belt 11. The fixing device 33 fixes the developer on the sheet P, and the output tray 34 outputs the sheet P on which the developer has been fixed by the fixing device 33.

The color image forming process in the color copying machine with the above-described structure will now be described.

When the start of the image forming operation has been instructed through the control panel 40, the main CPU 51 causes the printer CPU 110 to control the following image forming operation.

The photosensitive drum 3*a* receives a driving force from a driving mechanism (not shown) and starts rotating. The charger 5*a* uniformly charges the photosensitive drum 3*a* at about −600V.

The exposure device 7*a* illuminates light according to an image to be recorded on the photosensitive drum 3*a* uniformly charged by the charger 5*a*, thus forming an electrostatic latent image. The developing device 9*a* develops the electrostatic latent image on the photosensitive drum 3*a* by means of the developer, thus forming a yellow developer image.

By the same procedure as the formation of the developer image on the photosensitive drum 3*a*, developer images of magenta, cyan and black are formed on the photosensitive drums 3*b*, 3*c* and 3*d*.

On the other hand, the pickup roller 27 picks up a sheet P from the sheet feed cassette 26, and the register roller pair 29 feeds the sheet P onto the convey belt 11.

The convey belt 11 conveys the sheet P to the photosensitive drums 3*a*, 3*b*, 3*c* and 3*d* successively.

When the sheet P has reached a transfer region Ta formed by the photosensitive drum 3*a*, convey belt 11 and transfer member 23*a*, the DC power supply 25*a* applies a bias voltage of about +1000V to the transfer member 23*a*. A transfer electric field is created between the transfer member 23*a* and photosensitive drum 3*a*, and the developer image on the photosensitive drum 3*a* is transferred on the sheet P in accordance with the transfer electric field.

The sheet P, on which the developer image has been transferred in the transfer region Ta, is conveyed to a transfer region Tb. In the transfer region Tb, the DC power supply 25*b* applies a bias voltage of about +1200V to the transfer member 23*b*. Thus, the magenta developer image is transferred over the yellow developer image on the sheet P. After the magenta developer has been transferred, the sheet P is conveyed to a transfer region Tc and a transfer region Td.

In the transfer region Tc, the DC power supply 25*c* applies a bias voltage of about +1400V to the transfer member 23*c*. Thus, the cyan developer image is transferred over the yellow and magenta developer images on the sheet P.

Furthermore, in the transfer region Td, the DC power supply 25*d* applies a bias voltage of about +1600V to the transfer member 23*d*. Thus, the black developer image is transferred over the yellow, magenta and cyan developer images on the sheet P.

In this manner, the yellow, magenta, cyan and black developer images are multiply transferred on the sheet P in succession. The multiply transferred color developer images are fixed on the sheet P by the fixing device 33, and a color image is formed. The sheet P after fixation is delivered onto the output tray 34.

The transfer device 23*a*, 23*b*, 23*c*, 23*d* will now be described in greater detail.

Figure 4:
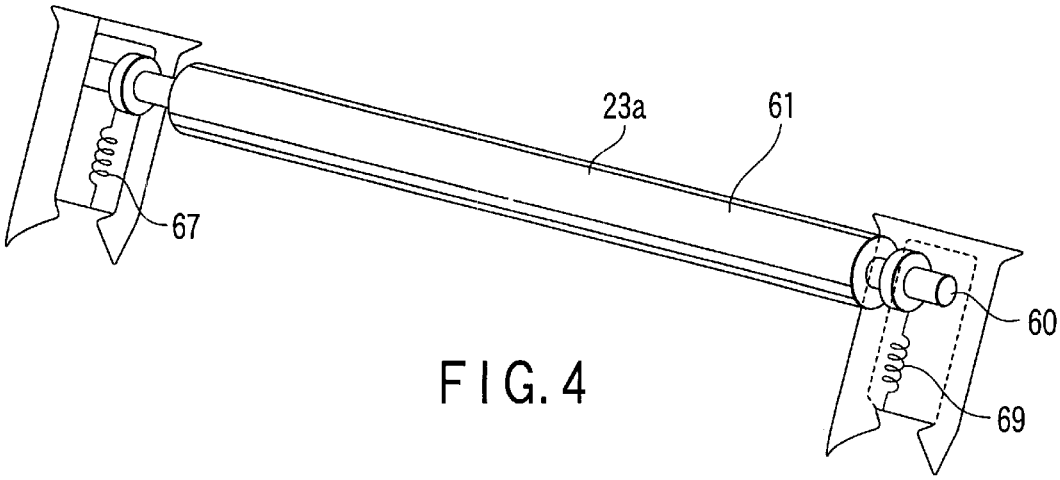
FIG. 4 shows an external structure of a transfer unit.

FIG. 4 shows an external structure of the transfer device 23*a*. The transfer device 23*a* is an electrically conductive foamed urethane roller which is made electrically conductive with carbon particles dispersed therein. Specifically, a metal core 60 with an outside diameter of 10 mm is covered with electrically conductive foamed urethane, and thus a roller 61 with an outside diameter of 18 mm is formed. The electrical resistance between the metal core 60 and roller 61 is about $10^6$ Ω. A fixed voltage DC power supply 25*a* is connected to the metal core 60.

A power supply device for the transfer device 23*a* is not limited to a roller, and may be an electrically conductive brush, an electrically conductive rubber blade, an electrically conductive sheet, etc. The electrically conductive sheet is a carbon-dispersed rubber material or resin film. For example, the conductive sheet may be a rubber material such as silicone rubber, urethane rubber or EPDM, or a resin material of polycarbonate, etc. It is preferable that the volume resistance be $10^5$ to $10^7$ Ωcm.

The transfer device 23*a* is disposed such that the center of the roller 61 is located vertically below the center of the photosensitive drum 3*a*.

Springs 67 and 69 functioning as urging means are provided at both ends of the shaft of the roller 61. The springs 67 and 69 vertically urge the transfer roller 23*a* and bring it in elastic contact with the convey belt 11. The magnitude of the urging force of the springs 67 and 69 provided at the roller 41 of the transfer device 23*a* is set at 600 gft. The urging force in this context is a sum of the urging force of 300 gft of the spring 67 and the urging force of 300 gft of the spring 69.

The structures of the transfer devices 23*b*, 23*c* and 23*d* are the same as the structure of the transfer device 23*a*. In addition, the structure for the elastic contact with the convey belt 11 is common between the transfer members. Accordingly, a description of the transfer devices 23*b*, 23*c* and 23*d* is omitted.

A first embodiment of the invention with the above structure will now be described.

FIG. 5 shows an example of prior-art display on the LCD section 42 of the control panel 40. The LCD section 42 displays keys 71 and 72 for adjusting image density. When the AUTO key 71 is depressed, the printer CPU 110 performs a control to automatically adjust the density of a copy image. The manual key 72 is a key for manually adjusting the density. When the manual key 72 is set to the right side, the printer CPU increases the density in accordance with the setting. When the manual key 72 is set to the left side, the printer CPU 110 decreases the density in accordance with the setting.

FIG. 6 shows an example of display according to the first embodiment on the LCD section 42 of the control panel 40. The LCD section 42 displays keys (IMAGE DENSITY) 71 and 72 for adjusting the image density, and keys (TRANSFER INTENSITY) 73 and 74 for directly varying the transfer bias. When the AUTO key 73 has been depressed, the printer CPU 110 causes the transfer bias control section 119 to perform a control to set the transfer biases from the DC power supplies 25*a*, 25*b*, 25*c* and 25*d* at normal conditions. When the manual key 74 is set to the right side, the printer CPU 110 increases the transfer biases in accordance with the setting. When the manual key 74 is set to the left side, the printer CPU 110 decreases the transfer biases in accordance with the setting.

For example, each time the setting of the manual key 74 is changed by one step, the printer CPU 110 increases/decreases the transfer biases by 50V. Specifically, in a case where the normal transfer bias conditions are Y=1300V, M=1300V, C=1400V and K=1400V, if the setting of the manual key 74 is changed by one step (one step to the right side), the conditions are set at Y=1350V, M=1350V, C=1450V and K=1450V.

Alternatively, each time the setting of the manual key 74 is changed by one step, the printer CPU 110 increases/decreases the transfer biases by 10%.

Figure 7:
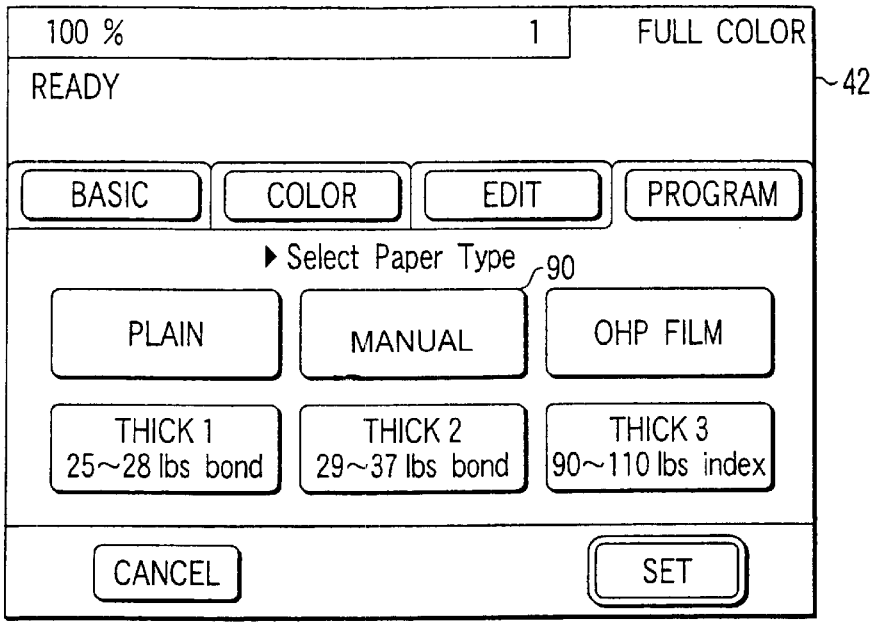
FIG. 7 shows another example of display according to the first embodiment on the LCD section.
Figure 8:
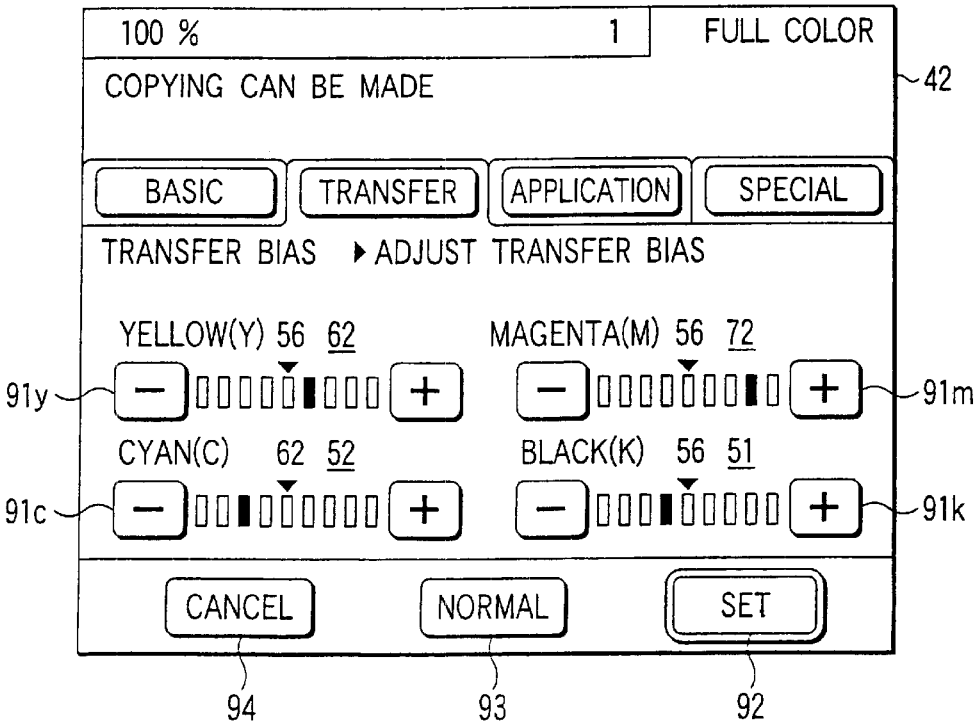
FIG. 8 shows another example of display according to the first embodiment on the LCD section.

FIG. 7 and FIG. 8 show another example of display on the LCD section 42 of the control panel 40. To start with, as shown in FIG. 7, a tab "PROGRAM" is selected on the initial display screen of the LCD section 42, and a MANUAL key 90 is selected. Thus, as shown in FIG. 8, keys 91*y*, 91*m*, 91*c* and 91*k* are displayed, which permit multi-step setting of transfer biases of yellow (Y), magenta (M), cyan (C) and black (K).

For example, in accordance with the kind of the transfer sheet, the transfer bias conditions for the respective colors may be finely adjusted, thereby to enhance the transfer properties and image quality. If optimal transfer bias conditions for various kinds of sheets are checked, it is found that the transfer bias conditions vary in a range of about several-hundred V, depending on the kind of sheet.

FIG. 9 shows optimal transfer bias conditions associated with the kinds of sheets. These optimal transfer bias conditions associated with the kinds of sheets are set in an RH environment with a temperature of 23° C. and a humidity of 50%. In the RH environment with a temperature of 23° C. and a humidity of 50%, the default transfer bias conditions for ordinary paper are Y (yellow)=1300V, M (magenta)=1300V, C (cyan)=1400V and K (black)=1300V, and these biases are applied.

In a monochromatic mode, the K (black) bias of 1100V is applied.

However, a sheet "Tidl DP", for instance, is used, it is preferable that Y=1300V to 1400V, M=1400V, C=1500V to 1600V and K=1400V be applied. In the monochromatic mode, it is preferable that K=1300V be applied.

The optimal transfer bias conditions vary depending on the kinds of sheets, as describes above. A procedure of manually changing the transfer bias conditions will now be described.

To start with, when the MANUAL key 90 on the "PROGRAM" on the touch panel of the LCD section 42 of control panel 40 is depressed, as shown in FIG. 7, the panel CPU 41 effects display of the transfer bias adjustment screen, as shown in FIG. 8.

The transfer bias conditions of the respective colors are adjusted through the transfer bias adjustment screen of FIG. 8 by depressing (+) or (−) of the keys 91*y*, 91*m*, 91*c* and 91*k*. Default setting values are displayed at the keys 91*y*, 91*m*, 91*c* and 91*k*. Adjusted set values with underlines are displayed beside the default values.

At last, when a setting key 92 on the transfer bias adjustment screen of FIG. 8 is depressed, the adjusted set value is fixed. Thereby, an instruction on the set values of the fixed transfer biases is sent to the printer CPU 110 via the panel CPU 41 and main CPU 51. The printer CPU 110 controls the DC power supplies 25*a*, 25*b*, 25*c* and 25*d* via the transfer bias control section 119 in accordance with the instructed set values of transfer biases. Thereby, bias voltages corresponding to the set values of transfer biases are applied to the transfer members 23*a*, 23*b*, 23*c* and 23*d* associated with the respective colors.

If a NORMAL key 93 on the transfer bias adjustment screen of FIG. 8 is depressed, the set values are reset at default set values.

In FIG. 8, the default transfer bias conditions are Y=56 bits, M=56 bits, C=62 bits, and K=56 bits. These values are set at Y=62 bits, M=72 bits, C=52 bits, and K=51 bits.

A second embodiment will now be described.

The second embodiment relates to a control method of transfer bias conditions in a case where the manual key 72 for density adjustment on the LCD section 42 of control panel 40 shown in FIG. 5 has been depressed.

When the user (operator) has depressed the manual key 72 on the LCD section 42 of operation panel 40 to set the density to the high density side, the printer CPU 110 switches the transfer bias conditions to confirm to high density original transfer conditions.

Specifically, the manual key 72 of the LCD section 42 in the color copying machine of this invention is capable of adjusting the density to the high density side in five steps of levels 1–5. When the density is set at level 4 or more on the high density side, the printer CPU 110 switches the normal transfer bias condition of 1300V for each color to the transfer bias condition of 1500V for each color.

On the other hand, when the user (operator) has depressed the manual key 72 on the LCD section 42 of operation panel 40 to set the density to the low density side, the printer CPU 110 switches the transfer bias conditions to confirm to low density original transfer conditions.

Specifically, the manual key 72 of the LCD section 42 in the color copying machine of this invention is capable of adjusting the density to the low density side in five steps of levels 1–5. When the density is set at level 4 or more on the low density side, the printer CPU 110 switches the normal transfer bias condition of 1300V for each color to the transfer bias condition of 1100V for each color.

A third embodiment will now be described.

Figure 10:
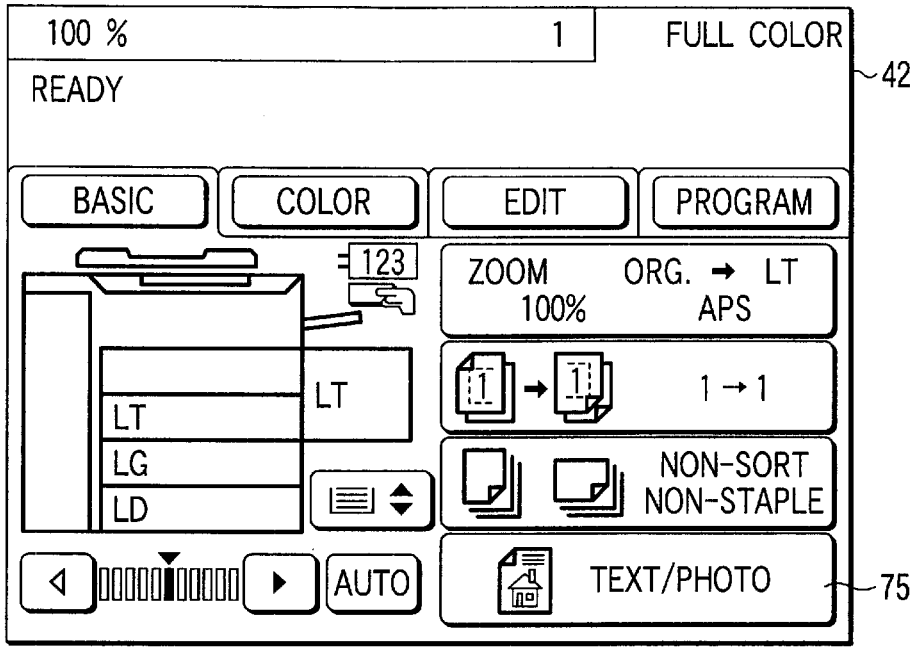
FIG. 10 shows an example of display on the LCD section according to a third embodiment.
Figure 11:
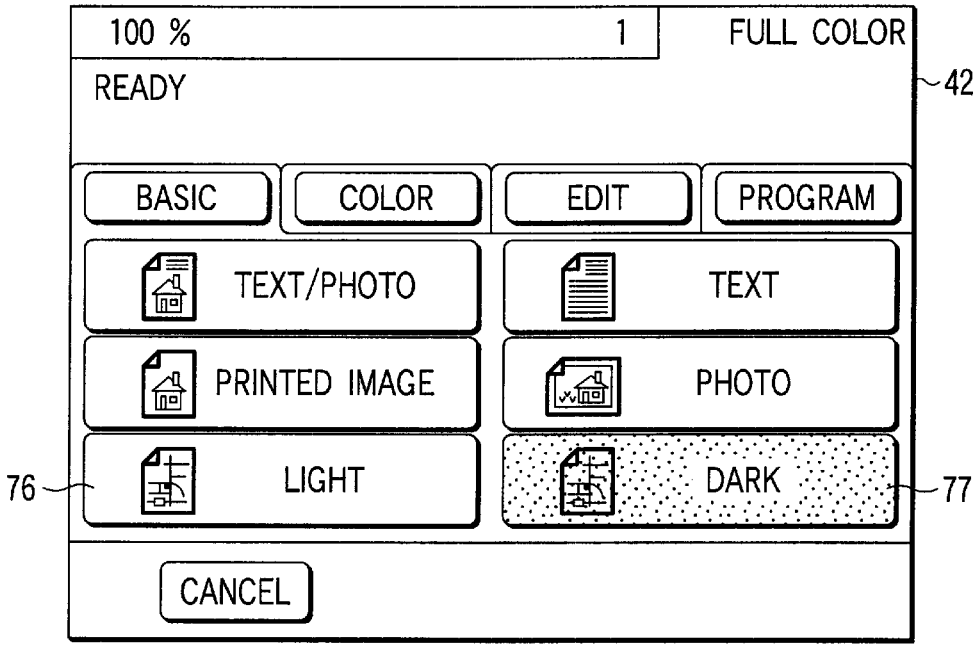
FIG. 11 shows an example of display on the LCD section according to the third embodiment.

FIGS. 10 and 11 show an example of display on the LCD section 42 of control panel 40 according to the third embodiment.

In this embodiment, when the user (operator) has judged that an original to be copied is a "high density image original" or "high print ratio image original" relating to a "high density image mode", the user can manually select one of "normal mode" and "high density image mode" on the LCD section 42 of control panel 40.

For example, when the user has judged that an original to be copied is a "high density image original" or "high print ratio image original", the user depresses a "TEXT/PHOTO" key 75 on the screen of the LCD section 42 shown in FIG. 10.

In this case, the panel CPU 41 causes the LCD section 42 to display a screen of FIG. 11, through which a "LIGHT" image mode or a "DARK" image mode can be selected. The LCD section 42 shown in FIG. 11 displays a LIGHT key 76 and a DARK key 77.

Since the user has judged that the original to be copied is a high density original, the user depresses the DARK key 77 for setting the high density image mode. Information on the depression of the DARK key 77 is sent to the printer CPU 110 via the panel CPU 41 and main CPU 51. Upon the selection of the DARK key 77, the printer CPU 110 switches the transfer bias conditions of the colors Y, M, C and K to values increased by +200V. Thereafter, the main CPU 51 controls the copying operation in response to a copy execution instruction by the user.

When the user has depressed the LIGHT key 76, information on the depression of the LIGHT key 76 is sent to the printer CPU 110 via the panel CPU 41 and main CPU 51. Upon the selection of the LIGHT key 76, the printer CPU 110 switches the transfer bias conditions of the colors Y, M, C and K to smaller values. Thereafter, the main CPU 51 controls the copying operation in response to a copy execution instruction by the user. The LIGHT key 76 is selected when a "highlight image mode" is to be set.

In addition, multi-step adjustment can be made.

In this case, after the DARK key 77 is depressed, as described above, the panel CPU 41 displays the multi-step fine adjustable screen of FIG. 8. The user selects desired conditions and executes the copying operation.

In this case, the desired conditions are sent to the printer CPU 110 via the panel CPU 41 and main CPU 51. Each time one step is increased, the printer CPU 110 increases the transfer bias by a degree of 10% of the normal bias. For example, if the normal bias value is 1300V, the transfer bias is increased up to 1313V by one step. Alternatively, each time one step is increased, the transfer bias can be increased by 50V. For example, the normal bias value is 1300V, the transfer bias is increased to 1350V.

Another conceptual example will now be described. In this example, the transfer bias is not adjusted on the LCD section 42, but it is altered based on the user's personal sense on the density of the original. In this example, the user can avoid complex setting and can intuitionally set the transfer bias.

Figure 12:
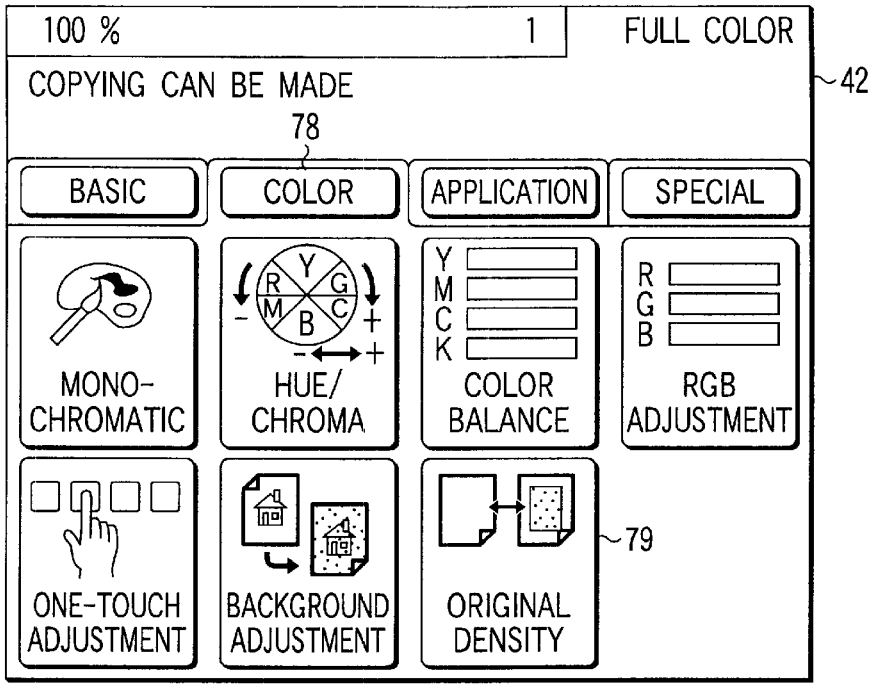
FIG. 12 shows another example of display on the LCD section according to the third embodiment.
Figure 13:
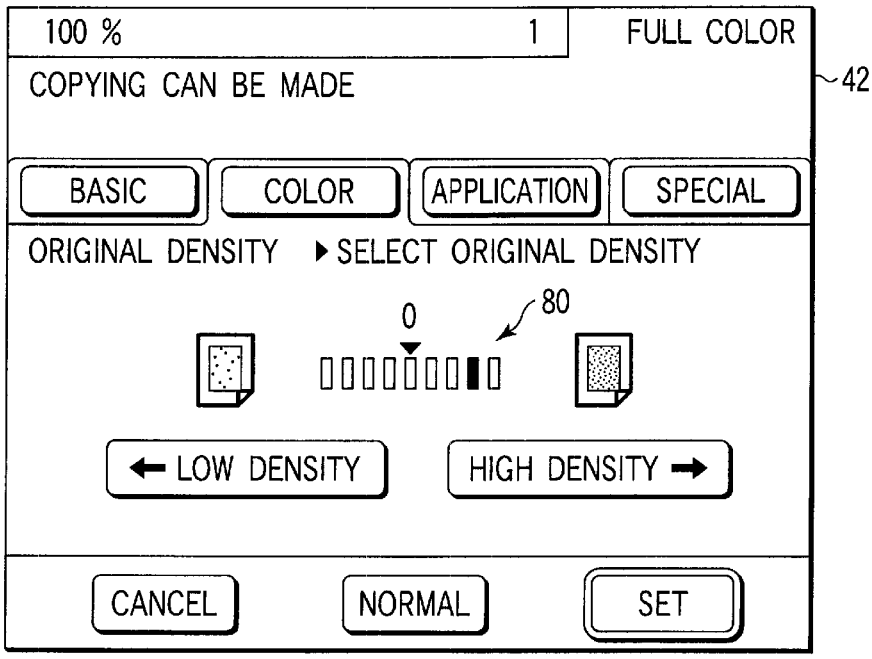
FIG. 13 shows another example of display on the LCD section according to the third embodiment.

FIGS. 12 and 13 show an example of display on the LCD section 42 associated with the above concept.

To start with, the user selects an "ORIGINAL DENSITY" key 79 in a "COLOR" tab 78 on the LCD section 42 shown in FIG. 12. The panel CPU 41 causes the LCD section 42 to display an original density adjustment screen shown in FIG. 13. If the user personally judges that the density of an original to be copied is high, the user sets the original density to the high density side by an original density key 80 on the original density adjustment screen of FIG. 13. An instruction on this setting is sent to the printer CPU 110 via the panel CPU 41 and main CPU 51. The printer CPU 110 switches the transfer bias conditions on the basis of the instructed setting.

In this case, each time the density is set to the high density side by one step, the transfer bias is increased by 50V.

Alternatively, each time the density is set to the high density side by one step, the transfer bias is increased by 10%.

A fourth embodiment will now be described.

In the fourth embodiment, when an original is placed on the original table, the main CPU 51 causes the scanner section 10 to pre-scan the original and calculate an average reflectance of the entire original, and sends the calculation result to the printer CPU 110.

When the sent result of average reflectance is 30% or less, the printer CPU 110 switches the transfer bias conditions to higher values. For example, if the transfer bias conditions of Y, M, C and K colors are 1300V, the printer CPU 110 sets the transfer bias conditions of the respective colors at 1500V.

When the sent result of average reflectance is 70% or more, the printer CPU 110 switches the transfer bias conditions to lower values. For example, if the transfer bias conditions of Y, M, C and K colors are 1300V, the printer CPU 110 sets the transfer bias conditions of the respective colors at 1100V.

Another example of the fourth embodiment will now be described.

When an original is placed on the original table, the main CPU 51 causes the scanner section 10 to pre-scan the original and calculate average reflectances of color-separated light components of Y, M and C of the original, and sends the calculation result to the printer CPU 110.

When the sent result of, e.g., the average reflectance of M, is 30% or less, the printer CPU 110 switches the transfer bias conditions to higher values. For example, if the transfer bias condition of M is 1300V, the printer CPU 110 sets the transfer bias condition of M at 1500V.

When the sent result of, e.g., the average reflectance of C, is 70% of more, the printer CPU 110 switches the transfer bias conditions to lower values. For example, if the transfer bias condition of C is 1300V, the printer CPU 110 sets the transfer bias condition of C at 1100V.

A fifth embodiment will now be described.

Figure 14:
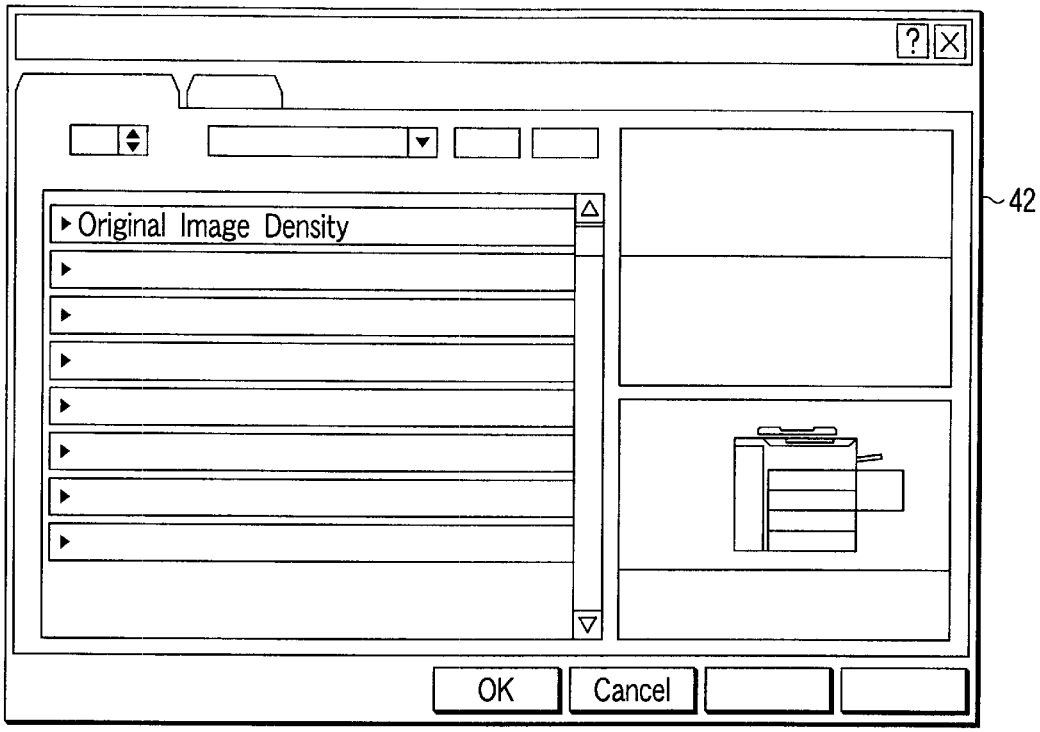
FIG. 14 shows an example of a setting screen of a personal computer used in a fifth embodiment.
Figure 15:
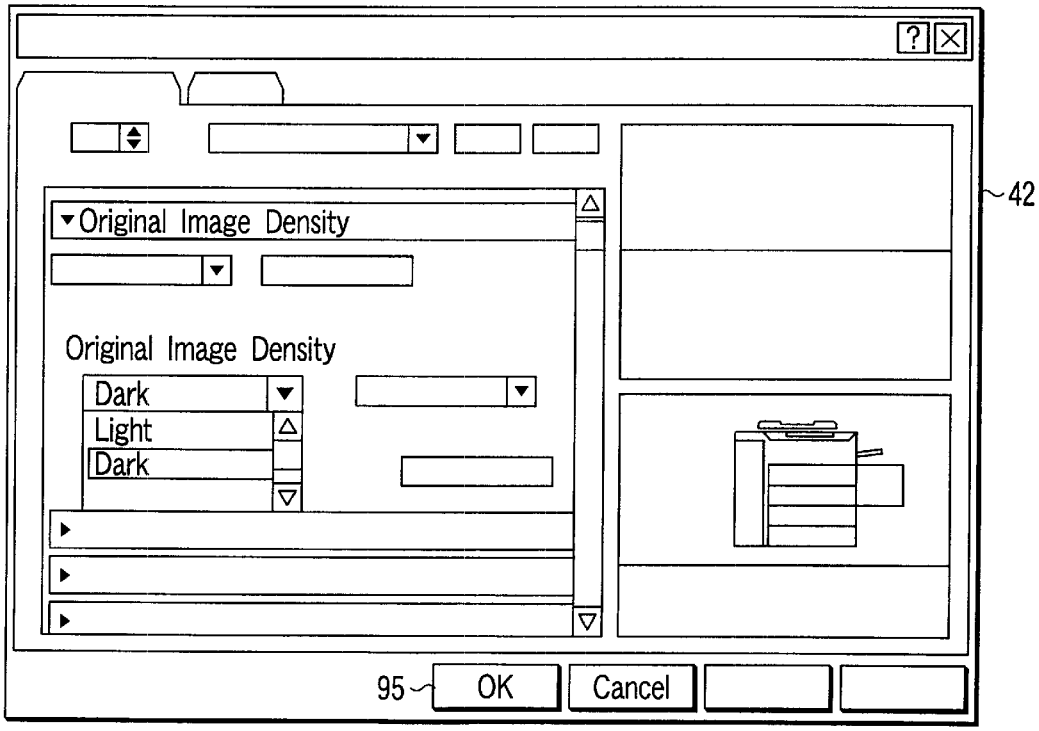
FIG. 15 shows an example of the setting screen of the personal computer used in the fifth embodiment.

FIGS. 14 and 15 show an example of a setting screen on a personal computer used in the fifth embodiment. The personal computer is the external device 122 shown in FIG. 2.

In the external device 122 serving as a personal computer, if printing is executed from application software (e.g. Windows), a graphical interface screen for printing is displayed ([File]-[Print]).

If the user personally thinks that the density of a whole print image is high, or that the density is low, the user changes the setting of the printer to a manual mode.

In this case, "Property" on the screen is clicked, and a property screen is displayed. Then, a tab of [Fiery Printing] is clicked and a print setting menu screen is displayed.

FIG. 14 shows an example of display on the print setting menu screen. On the print setting menu screen, an "Original Image Density" option bar is selected. When the density of the print image is low, "LIGHT" is selected from a pop-up menu of "Original Image Density". When the density is high, "DARK" is selected.

FIG. 15 shows an example of display of the pop-up menu of the "Original Image Density", and "DARK" is selected.

After this setting is completed, an OK key 95 is clicked and printing is effected.

As has been described above, "LIGHT" or "DARK" is manually selected, and the transfer bias conditions are automatically switched in the color copying machine of the present invention.

In the color copying machine of the present invention, the transfer bias conditions for the "LIGHT" or "DARK" modes are prepared as a lookup table in the ROM 111 in the printer section 20.

For example, in the case of the "LIGHT" mode, bias voltages, which are uniformly decreased by 200V from the normal transfer bias conditions, are applied. If the normal transfer bias conditions are Y=1300V, M=1300V, C=1300V and K=1300V, bias voltages of Y=1100V, M=1100V, C=1100V and K=1100V are applied.

In the case of the "DARK" mode, bias voltages, which are uniformly increased by 200V from the normal transfer bias conditions, are applied.

A sixth embodiment will now be described.

In the sixth embodiment, if the print ratio of an image to be printed is 70% or more of the whole page, the transfer bias conditions are automatically switched to transfer bias conditions for a high print ratio image.

Alternatively, if the print ratio of an image of any one of Y, M, C and K colors, which is to be printed, is 70% or more of the whole page, the transfer bias condition of the associated color is automatically switched to a transfer bias condition for a high print ratio image.

On the other hand, if the print ratio is 30% or less, the transfer bias condition is switched to a low print ratio image.

The transfer bias condition for a low print ratio image and the transfer bias condition for a high print ratio image are switched by the printer CPU 110 of the printer section 20. The printer CPU 110 switches the transfer bias condition on the basis of the normal transfer bias condition set as a lookup table in the ROM 111 of printer section 20.

If the print ratio of M and C, for instance, is 90%, the printer CPU 110 effects printing, with the transfer bias conditions of M and C increased by 10%. Specifically, if the normal transfer bias conditions set in the lookup table in the ROM 111 are M=1100V and C=1100V, the printer CPU 110 switches the bias conditions to M=1210V and C=1210V.

A seventh embodiment will now be described.

In the seventh embodiment, the color copying machine of the present invention is connected to the Web network via the external device 122 functioning as interface.

A personal computer (not shown) can effect maintenance of the color copying machine of the present invention via the Web network. In this case, the personal computer (not shown) switches the transfer bias conditions of Y, M, C and K in the printer section 20 of the color copying machine of the present invention.

As has been described above, according to the embodiments of the present invention, the user can manually select, on the control panel, the optimal transfer bias conditions associated with the kinds of sheets and the environment. Therefore, a high-quality transfer image can be obtained.

A high-quality transfer image can be obtained by automatically switching the transfer bias condition in accordance with the density of an image to be printed.

The user can manually optimize the transfer bias condition in accordance with the density of the original, and a high-quality transfer image can be obtained.

A high-quality transfer image can be obtained by prescanning the density of the original and automatically switching the transfer bias conditions.

The user manually selects a mode in accordance with the density of an image to be printed by the printer and switches the transfer bias conditions. Thus, a high-quality transfer image can be obtained.

A high-quality transfer image can be obtained by automatically switching the transfer bias conditions in accordance with the density of an image to be printed by the printer.

A high-quality performance can be maintained by switching the transfer bias conditions via a network in a printer connected to the network and maintained via the network.

What is claimed is:

1. An image forming apparatus comprising:

developing means for forming toner images on a plurality of image carrying bodies;

a transfer belt for conveying a sheet, the transfer belt being disposed in contact with the image carrying bodies on which the toner images are formed by the developing means;

a plurality of transfer means, provided at positions where the transfer belt is put in contact with the image carrying bodies, for transferring the toner images formed on the respective image carrying bodies onto the sheet conveyed by the transfer belt;

setting means for setting transfer bias conditions of the plural transfer means; and control means for controlling bias voltages applied to the respective transfer means in accordance with the transfer bias conditions set by the setting means;

wherein said setting means alters and sets the transfer bias conditions with reference to normal transfer bias conditions such that the transfer bias conditions increase by 10% or decrease by 10% in units of a step.

2. An image forming apparatus comprising:

developing means for forming toner images on a plurality of image carrying bodies;

a transfer belt for conveying a sheet, the transfer belt being disposed in contact with the image carrying bodies on which the toner images are formed by the developing means;

a plurality of transfer means, provided at positions where the transfer belt is put in contact with the image carrying bodies, for transferring the toner images formed on the respective image carrying bodies onto the sheet conveyed by the transfer belt;

setting means for setting transfer bias conditions of the plural transfer means; and control means for controlling bias voltages applied to the respective transfer means in accordance with the transfer bias conditions set by the setting means;

wherein said setting means alters and sets the transfer bias conditions with reference to normal transfer bias conditions such that the bias voltages used as the transfer bias conditions increase by 50V or decrease by 50V in units of a step.

3. An image forming apparatus comprising:

read means for reading an image on an original;

developing means for forming toner images on a plurality of image carrying bodies on the basis of the original image read by the read means;

a transfer belt for conveying a sheet, the transfer belt being disposed in contact with the image carrying bodies on which the toner images are formed by the developing means;

a plurality of transfer means, provided at positions where the transfer belt is put in contact with the image carrying bodies, for transferring the toner images formed on the respective image carrying bodies onto the sheet conveyed by the transfer belt;

adjustment means for adjusting in multiple steps an image formation density of the original when the image on the original is read by the read means; and control means for controlling, when the image formation density of the original has been adjusted to a high density side or a low density side by the adjustment means, the transfer bias conditions of the plurality of transfer means in accordance with the adjustment step on the high density side or the adjustment step on the low density side, wherein said control means controls, when the image formation density has been adjusted to the high density side or the low density side, the transfer bias conditions with reference to normal transfer bias conditions such that the transfer bias conditions increase by 10% or decrease by 10% in units of a step.

4. An image forming apparatus comprising:

read means for reading an image on an original;

developing means for forming toner images on a plurality of image carrying bodies on the basis of the original image read by the read means;

a transfer belt for conveying a sheet, the transfer belt being disposed in contact with the image carrying bodies on which the toner images are formed by the developing means;

a plurality of transfer means, provided at positions where the transfer belt is put in contact with the image carrying bodies, for transferring the toner images formed on the respective image carrying bodies onto the sheet conveyed by the transfer belt;

adjustment means for adjusting in multiple steps an image formation density of the original when the image on the original is read by the read means; and control means for controlling, when the image formation density of the original has been adjusted to a high density side or a low density side by the adjustment means, the transfer bias conditions of the plurality of transfer means in accordance with the adjustment step on the high density side or the adjustment step on the low density side, wherein said control means controls, when the image formation density has been adjusted to the high density side or the low density side, the transfer bias conditions with reference to normal transfer bias conditions such that bias voltages used as the transfer bias conditions increase by 50V or decrease by 50 V in units of a step.

5. An image forming apparatus comprising:

read means for reading an image by scanning an original;

developing means for forming toner images on a plurality of image carrying bodies on the basis of the original image read by the read means;

a transfer belt for conveying a sheet, the transfer belt being disposed in contact with the image carrying bodies on which the toner images are formed by the developing means;

a plurality of transfer means, provided at positions where the transfer belt is put in contact with the image carrying bodies, for transferring the toner images formed on the respective image carrying bodies onto the sheet conveyed by the transfer belt;

calculation means for calculating an average reflectance of the whole image of the original with respect to each of color components of yellow, magenta, cyan and black, when the original is pre-scanned by the read means; and control means for performing a control to switch, when the average reflectance calculated by the calculation means with respect to each of the color components of yellow, magenta, cyan and black is a predetermined first set value or less, transfer bias conditions of the plural transfer images to transfer bias conditions for a high density image, and to switch, when the average reflectance calculated by the calculation means with respect to each of the color components of yellow, magenta, cyan and black is a second set value or more, which is different from said predetermined first set value, the transfer bias conditions of the plural transfer images to transfer bias conditions for a low density image.

6. An image forming apparatus according to claim 5, wherein the first set value used in the control means is a reflectance of 30%, and the second set value used in the control means is a reflectance of 70%.

7. An image forming system wherein a personal computer is connected to an image forming apparatus via a communication line to form an image, the personal computer comprising:

display means for displaying a screen for controlling the image forming apparatus; and setting means for selecting and setting one of a high density image transfer mode and a low density image transfer mode associated with transfer bias conditions in the image forming apparatus, by means of said screen displayed on the display means for controlling the image forming apparatus, said image forming apparatus comprising:

developing means for forming toner images on a plurality of image carrying bodies;

a transfer belt for conveying a sheet, the transfer belt being disposed in contact with the image carrying bodies on which the toner images are formed by the developing means;

a plurality of transfer means, provided at positions where the transfer belt is put in contact with the image carrying bodies, for transferring the toner images formed on the respective image carrying bodies onto the sheet conveyed by the transfer belt; and control means for controlling bias voltages applied to the transfer means on the basis of the transfer bias conditions associated with the high density image transfer mode or low density image transfer mode set by the setting means.

8. An image forming apparatus according to claim 7, wherein the high density image transfer mode is indicative of a darker image and the low density image transfer mode is indicative of a lighter image.

9. An image forming apparatus comprising:

read means for reading an image on an original;

developing means for forming toner images on a plurality of image carrying bodies on the basis of the original image read by the read means;

a transfer belt for conveying a sheet, the transfer belt being disposed in contact with the image carrying bodies on which the toner images are formed by the developing means;

a plurality of transfer means, provided at positions where the transfer belt is put in contact with the image carrying bodies, for transferring the toner images formed on the respective image carrying bodies onto the sheet conveyed by the transfer belt;

control means for performing a control to switch, when a print ratio of the original read by the read means is a predetermined first print ratio or more, transfer bias conditions of the plural transfer images to transfer bias conditions for a high density image, and to switch, when the print ratio of the original read by the read means is a second print ratio or less, which is different from said predetermined first print ratio, the transfer bias conditions of the plural transfer images to transfer bias conditions for a low density image, wherein said control means performs a control to switch the transfer bias conditions of the plural transfer means in accordance with the print ratio of each of color components of yellow, magenta, cyan and black on the original read by the read means.

10. An image forming apparatus according to claim 9, wherein said control means performs the switching control with the first print ratio of 70% and the second print ratio of 30%.

* * * * *